US005221326A

United States Patent [19]

Yamaguchi et al.

[11] Patent Number: 5,221,326

[45] Date of Patent: Jun. 22, 1993

[54] METHOD OF PRODUCING ULTRA-LOW-CARBON STEEL

[75] Inventors: Koji Yamaguchi; Yasuo Kishimoto; Toshikazu Sakuraya; Masaru Washio; Kazuhisa Hamagami; Hiroshi Nishikawa, all of Chiba, Japan

[73] Assignee: Kawasaki Steel Corporation, Kobe, Japan

[21] Appl. No.: 700,605

[22] Filed: May 15, 1991

[30] Foreign Application Priority Data

May 17, 1990 [JP] Japan ..... 2-125433
Jun. 25, 1990 [JP] Japan ..... 2-164196
Sep. 10, 1990 [JP] Japan ..... 2-237163

[51] Int. Cl.[5] ..... C21C 7/10
[52] U.S. Cl. ..... 75/512
[58] Field of Search ..... 75/512

[56] References Cited

U.S. PATENT DOCUMENTS 3,236,635 2/1966 Finkl ..... 75/512
3,337,329 8/1967 Finkl ..... 75/512
4,647,306 3/1987 Abratis ..... 75/512

*Primary Examiner*—Peter D. Rosenberg
*Attorney, Agent, or Firm*—Dvorak and Traub

[57] ABSTRACT

A method of producing an ultra-low-carbon steel by conducting vacuum-decarburization of a molten steel by means of a vacuum degasifier of the type having recirculation pipes and a vacuum chamber. When the carbon content of the molten steel has come down to a level of 50 ppm or less, hydrogen gas is introduced together with an inert gas into the molten steel either by directly injecting a hydrogen-containing gas into the molten steel in the vacuum chamber through a tuyere provided in the wall of the vacuum chamber or by blowing the hydrogen-containing gas onto the surface of the molten steel in the vacuum chamber through a lance provided in the vacuum chamber. In order to enhance the effect produced by the method of the present invention, it is possible to take an additional measure such as blowing of hydrogen gas through a tuyere provided in the wall of the recirculation pipe or injection of hydrogen or hydrogen-containing gas through an injection lance immersed in the molten steel held in, a ladle.

6 Claims, 11 Drawing Sheets

METHOD OF PRODUCING ULTRA-LOW-CARBON STEEL

BACKGROUND OF THE INVENTION

1. Field of the Invention

The present invention relates to a method of producing an ultra-low-carbon steel which can produce, by using a vacuum degasifier, an ultra-low-carbon steel from non-deoxidized or slightly deoxidized molten steel prepared by a steel making furnace, particularly a combined blowing converter or an LD converter, without shortening the life of the production apparatus.

2. Description of the Related Art

A continuous annealing apparatus, which has become available in recent years, has created a remarkable increase of the productivity of cold-rolled steel strips. This continuous annealing system has given a rise to the demand for ultra-low-carbon steel having a carbon content of 10 ppm or less.

Conventionally, an ultra low-carbon steel has been produced by decarburizing a molten steel until the carbon content is reduced to 0.02 to 0.05 wt% by using a converter, and then further decarburizing the steel under a reduced pressure by a vacuum degasifier such as an RH degasifier.

The conventional decarburizing method which utilizes a vacuum degasifier, however, could not produce ultra-low-carbon steel having a carbon content [C] less than 10 ppm in an industrial scale, because the decarburization rate is drastically decreased when the carbon content [C] has been reduced to a level less than 50 ppm.

For the purpose of enhancing the decarburization rate, it has been considered significant to increase the area of the reaction site. With this knowledge, it has been attempted to enhance the reaction rate by increasing the area of the reaction site area. Gas bubbles in molten steel or, surface of the molten steel in a vacuum chamber, or splash metal in the vacuum chamber is considered reaction site. It is still unclear, however, what degrees of contribution are made by these means to increase the reaction site area. Conventionally, it has been a common recognition that the above-mentioned three reaction sites will be increased by increasing the rate of supply of the Ar gas for agitation or recirculation. With this knowledge, it has been attempted to supply an RH degasifier with Ar gas at a large rate of 20 $Nm^3$/min or so.

Blowing of Ar gas at such a large rate, however, causes a problem in that the degasifier cannot operate continuously due to deposition of splash metal to the inner surface of the vacuum chamber of the vacuum degasifier as a result of vigorous generation of splash metal caused by the blowing of Ar gas.

In order to obviate the above-described problem, a method has been proposed and used in which hydrogen gas or a hydrogen-containing gas is blown into a molten steel so as to increase the content of hydrogen dissolved in the molten steel [H]. According to this method, a reaction expressed by $2H \rightarrow H_2$ takes place to generate bubbles of hydrogen gas so as to enhance the effect of agitation and to increase the decarburization rate by the increase in the area of the reaction sites. This method is disclosed in Japanese Patent Laid-Open No. 57-194206.

It has been confirmed that this method can increase the decarburization rate in the low carbon region and, hence, contributes to improvement in the efficiency of production of ultra-low-carbon steel. This method, however, requires that the hydrogen content is maintained at a sufficiently high level, e.g., 3 to 5 ppm, in order to provide an appreciable effect in promoting decarburization. To maintain such a high hydrogen content, it has been required that hydrogen is blown at a rate not smaller than 5 $Nm^3$/min, when an RH degasifier having a capacity of, for example, 250 tons is used. This causes various problems such as an increase in the rate of generation of splash metal in the vacuum chamber, and shortening of the life of gas-blowing tuyere.

Moreover, the rate of utilization of hydrogen decreases, as the rate of hydrogen gas increases through the tuyeres provided in the side of the wall of recirculation pipe. Hence, it has been very difficult to maintain hydrogen content at such a high level by injecting hydrogen gas through the tuyeres provided in the side of the wall of the recirculating pipe.

SUMMARY OF THE INVENTION

Accordingly, an object of the present invention is to eliminate the shortcomings and industrial problems encountered with the above-described method which relies on blowing of hydrogen gas.

Another object of the present invention is to provide a method which enables production of an ultra-low-carbon steel having a carbon content [C] not greater than 10 ppm.

Still another object of the present invention is to provide a practical means for supplying hydrogen, as well as operating conditions, which enables achievement of the above-described objects of the invention.

To these ends, according to one aspect of the present invention, there is provided a method of producing an ultra-low-carbon steel by vacuum-decarburizing a molten steel by means of a vacuum degasifier of the type having recirculation pipes and a vacuum chamber, the method comprising: introducing, when the carbon content of the molten steel is 50 ppm or less, hydrogen gas together with an inert gas into the molten steel either by directly injecting a hydrogen-containing gas into the molten steel in the vacuum chamber through a tuyere provided in the wall of the vacuum chamber or by blowing the hydrogen-containing gas onto the surface of the molten steel in the vacuum chamber through a lance provided in the vacuum chamber.

In order to enhance the effect produced by the method of the present invention, it is possible to take an additional method such as injecting of hydrogen gas through a tuyere provided in the wall of the recirculation pipe or injection of hydrogen or hydrogen-containing gas through an injection lance immersed in the molten steel held by a ladle.

These and other objects, features and advantages of the present invention will become clear from the following description of the preferred embodiments when the same is read in conjunction with the accompanying drawings

DESCRIPTION OF THE PREFERRED EMBODIMENTS

The method of the present invention has the following major features (1) to (3):

(1) The method of the present invention is carried out by using a vacuum degasifier (referred to also as "RH apparatus") which typically has a gas recirculation pipe and a vacuum chamber. Although the invention does not exclude the use of other type of vacuum degasifier, the use of RH apparatus is preferred because the vacuum decarburization using such an RH apparatus is used broadly and, when the invention is carried out by using an existing RH apparatus, the decarburization can be achieved to such a degree as could never be attained by conventional method.

(2) According to the invention, introduction of hydrogen is commenced when the carbon content [C] in the molten steel has come down to a level lower than 50 ppm.

Figure 1:
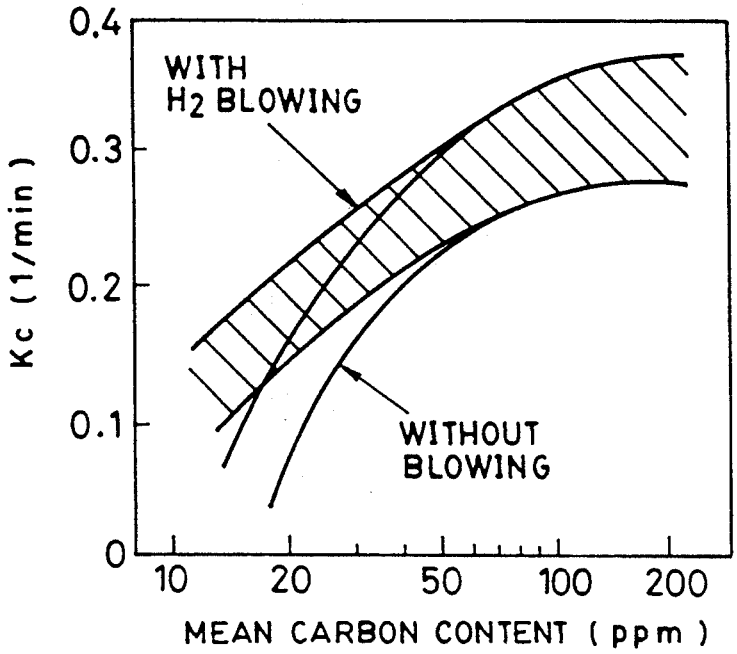
FIG. 1 is a graph showing the relationship between a decarburization rate constant Kc and mean carbon content [C] as observed when hydrogen gas is introduced into a molten steel through a hydrogen-blowing tuyere.
Figure 6A:
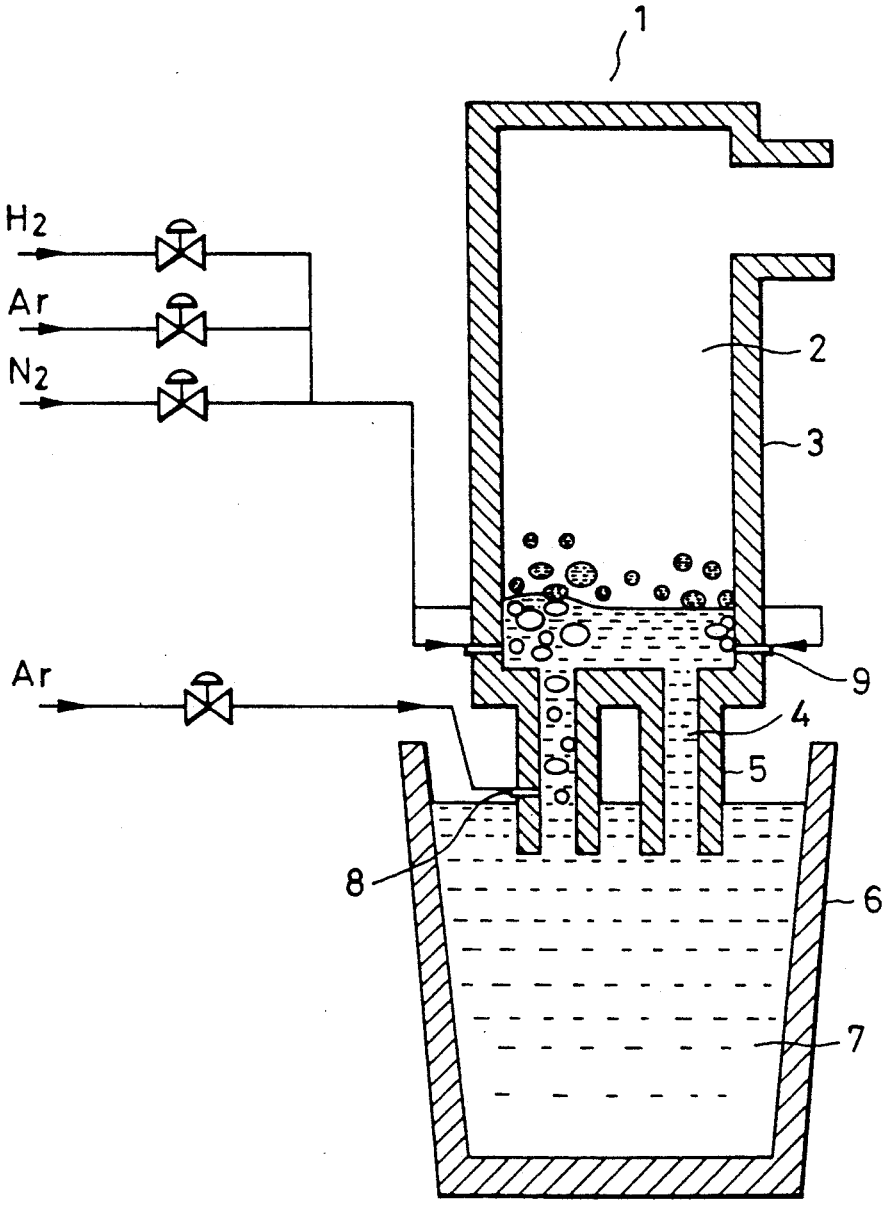
FIGS. 6(*a*) to 6(*f*) are schematic sectional views of equipment suitable for use in carrying out the method of the present invention.
Figure 6B:
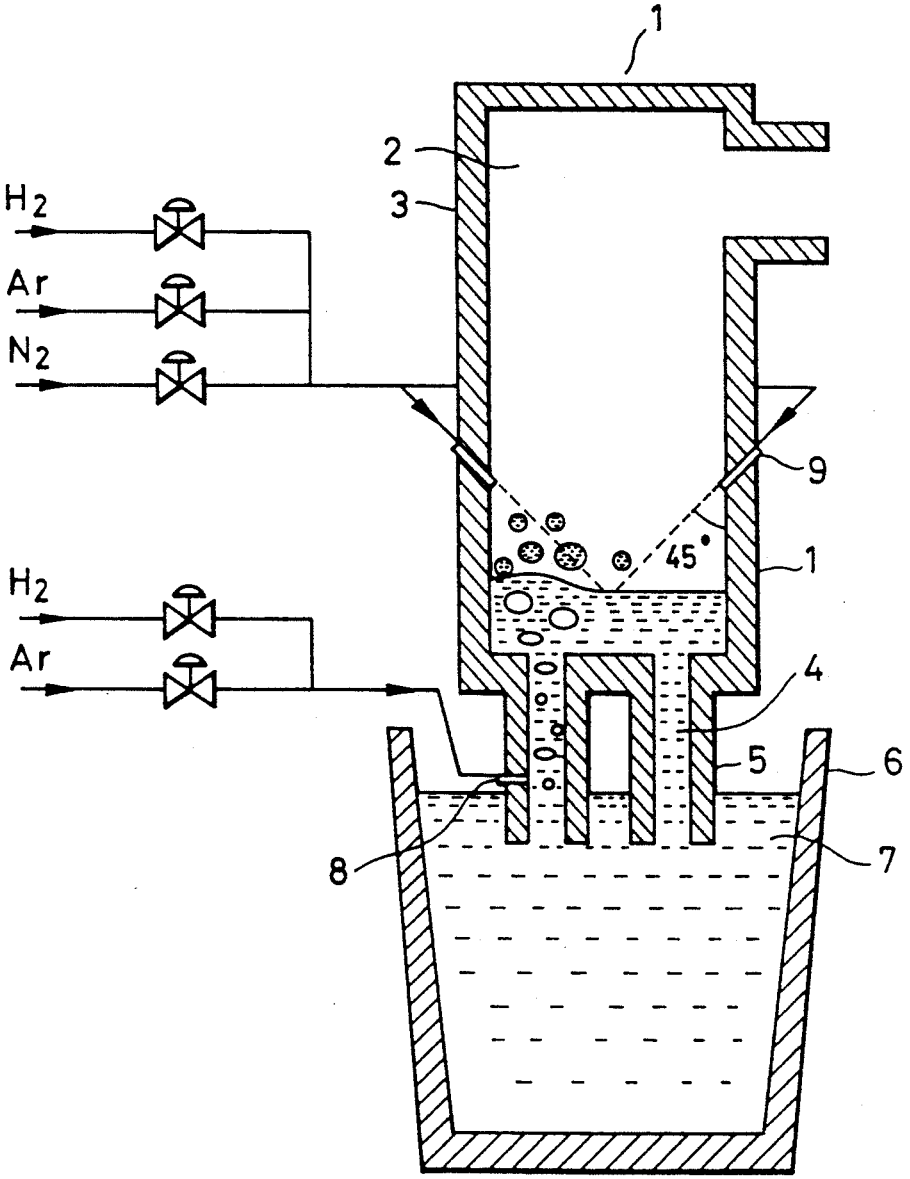
Figure 6C:
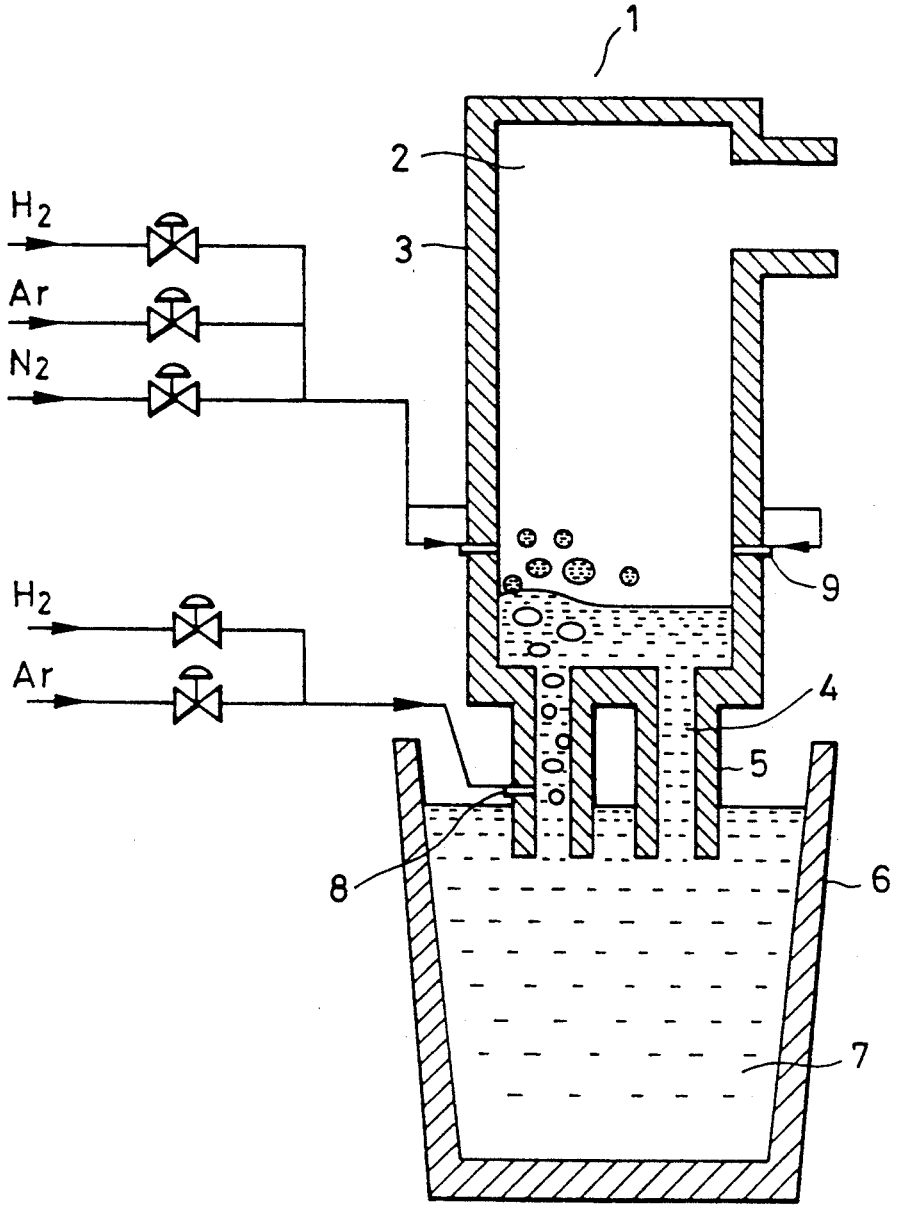
Figure 6:
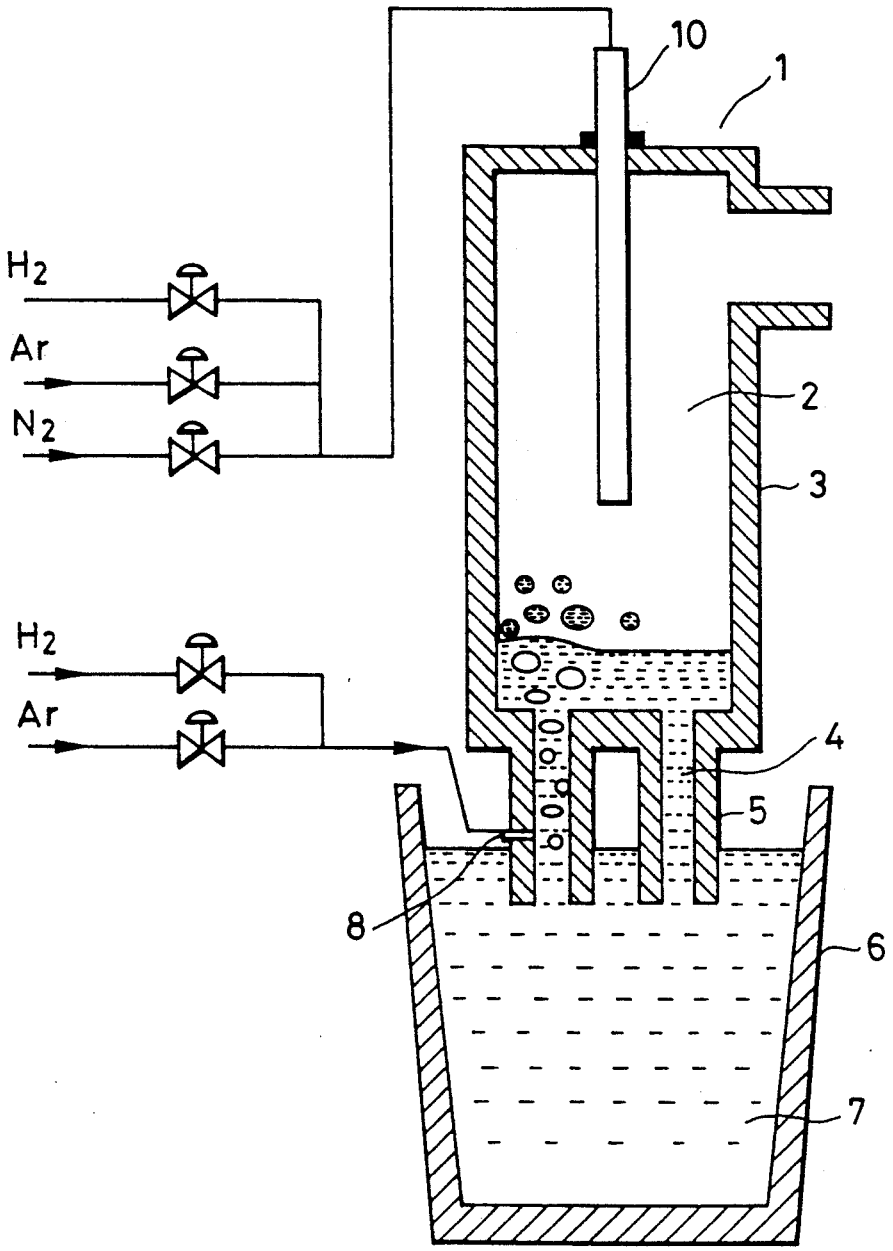
Figure 6E:
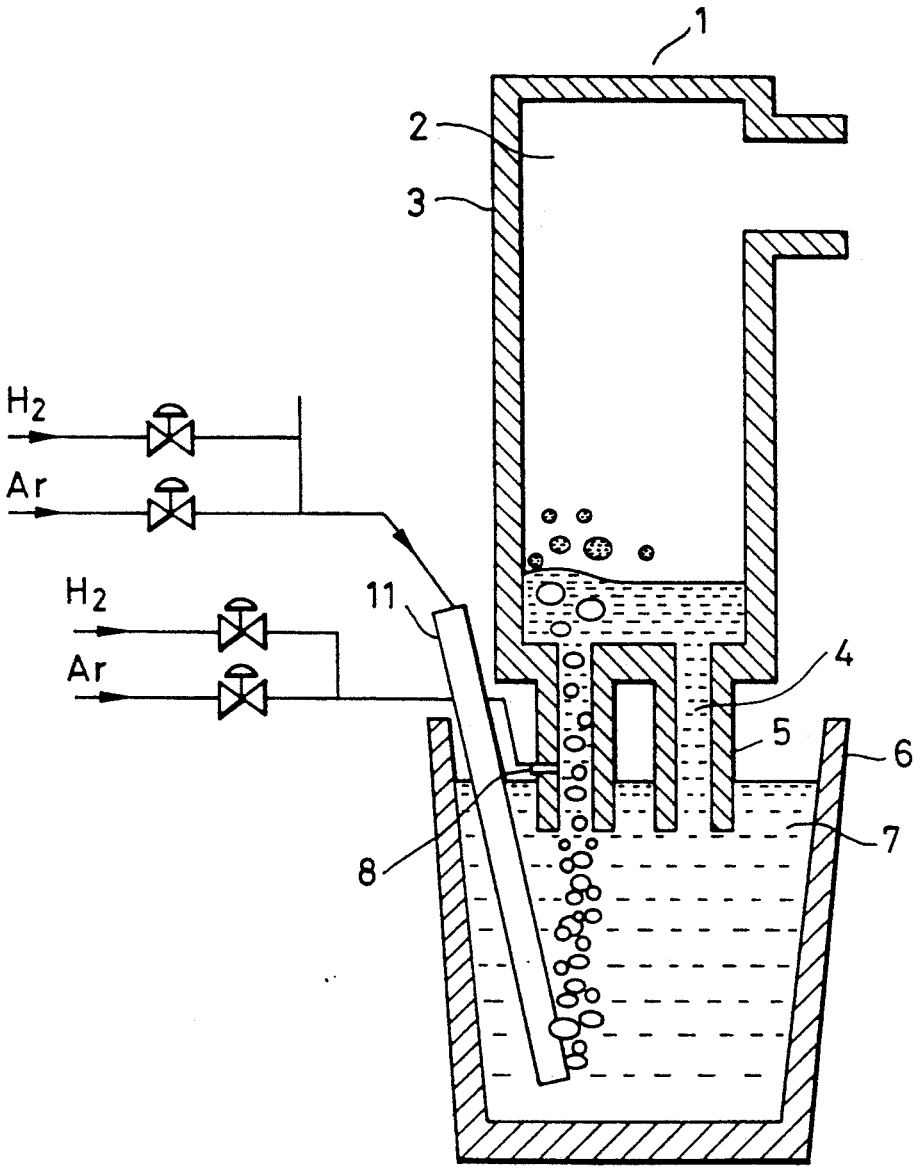
Figure 6F:
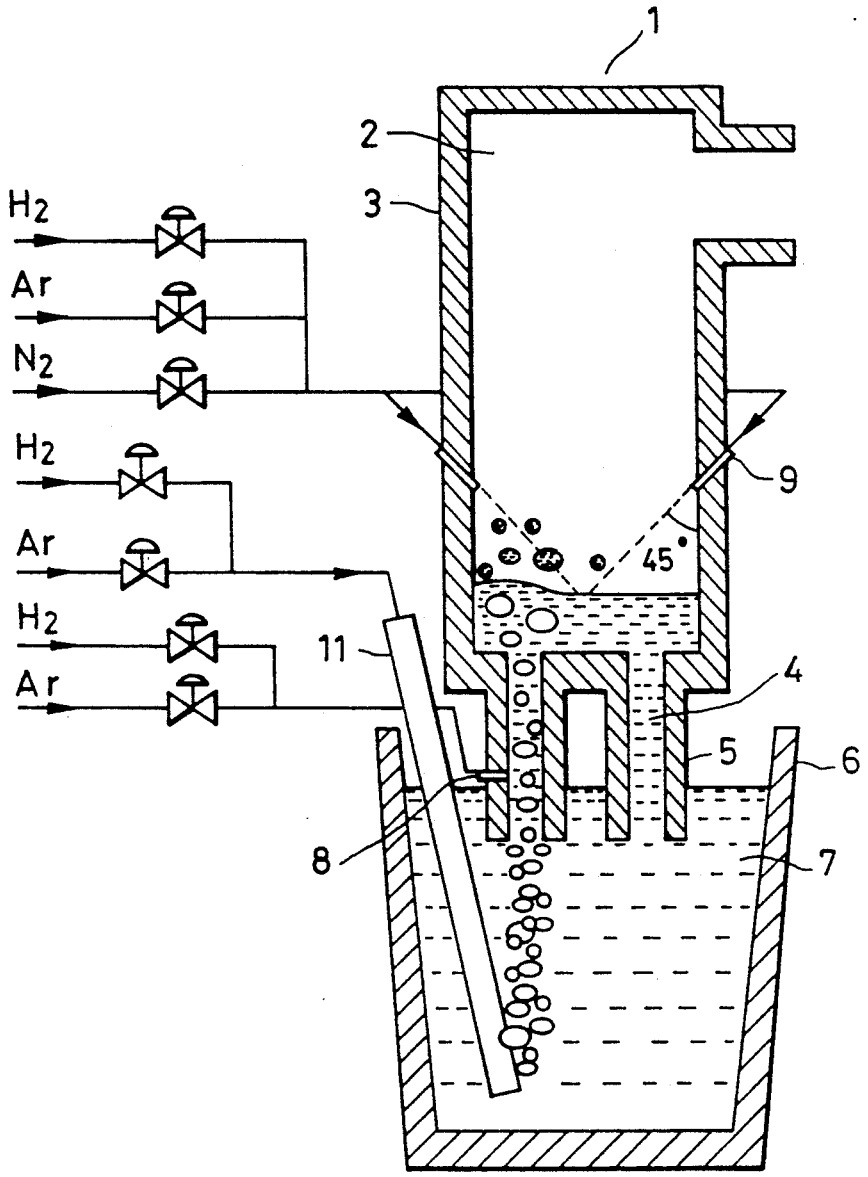

FIG. 1 shows the relationship between the decarburization rate constant Kc and the mean carbon content [C] as observed when the method of the present invention is carried out by an apparatus shown in FIG. 6(*a*).

As will be seen from FIG. 1, the improvement achieved by the introduction of hydrogen gas is not appreciable when the carbon content [C] is not less than 50 ppm. Namely, introduction of hydrogen gas under the condition of the carbon content [C] being not less than 50 ppm results only in uneconomical wasting of hydrogen. In contrast, when the carbon content [C] is less than 50 ppm, the decarburization varies depending on whether the introduction of hydrogen gas is conducted or not. It has been confirmed that the effect of introduction of hydrogen gas is noticeable only in the region of the carbon content being less than 50 ppm. The term decarburization rate constant Kc is the constant which represents the rate of decarburization which proceeds in the form of a primary reaction. Thus, the decarburization rate constant Kc is expressed as follows:

$$-d[C]/dt = Kc[C]$$

where, [C] represents the carbon content in the molten steel.

(3) The third feature of the method in accordance with the present invention is that the introduction of hydrogen is conducted by injecting hydrogen together with an inert gas directly into a molten steel in a vacuum chamber of a degasifier, through a tuyere provided on the sidewall of the vacuum chamber or, alternatively, by blowing the hydrogen onto the surface of the molten steel in the vacuum chamber through a lance which is extended into the vacuum chamber.

The method of introducing hydrogen gas will be described with reference to FIGS. 6(*a*) to 6(*d*).

FIG. 6(*a*) shows a method in which a hydrogen-containing gas is injected into the molten steel through hydrogen gas injecting tuyeres 9 which open in the wall 3 of a vacuum chamber 2 at a level below the surface of the molten steel.

FIG. 6(*b*) shows a method in which a hydrogen-containing gas is introduced obliquely downward towards the surface of the molten steel from hydrogen-blowing tuyeres 9 which open in the wall 3 of the vacuum chamber 2 above the molten steel surface.

FIG. 6(*c*) shows a method in which a hydrogen-containing gas is introduced into the vacuum chamber 2 through tuyeres which open in the wall 3 of the vacuum chamber 2 at a level which is within 1200 mm from the surface of the molten steel.

FIG. 6(*d*) shows a method in which a hydrogen-containing gas is introduced onto the surface of the molten steel through a top blowing lance 10.

Figure 2:
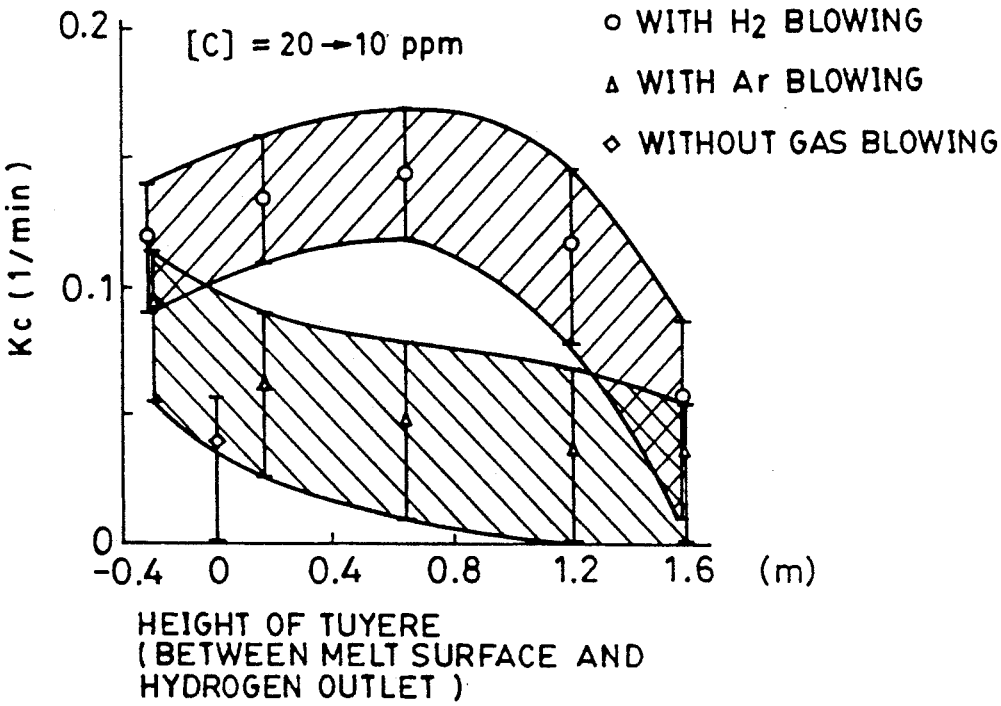
FIG. 2 is a graph showing the relationship between the height of tuyere as measured from a supposed steel melt surface level and the decarburization rate constant Kc in ultra-low-carbon region, obtained when hydrogen gas is horizontally introduced into a vacuum chamber.

FIG. 2 shows the relationship between the apparent decarburization rate constant Kc during reduction of the carbon content [C] from 20 ppm to 10 ppm and the height of eight tuyeres 9 measured from the assumed surface of the molten steel, as observed when the hydrogen gas is blown at a rate of 7.5 $Nm^3$/min through the eight tuyeres 9 which are provided on the wall 3 of a vacuum chamber 2 of an RH degasifier having a capacity of 250 tons shown in FIG. 6(*c*). FIG. 2 also shows, for the purpose of comparison, the above-mentioned relationship as observed when no blowing of the gas is conducted and when the Ar gas is blown through the eight tuyeres 9. The term "supposed surface of molten steel" is used to mean a level which is about 1.48 m in terms of static head of molten steel, higher than the molten steel level in the ladle 6 under the RH treatment.

As will be seen from FIG. 2, when hydrogen gas is introduced, a greater value of decarburization rate constant Kc is obtained as compared with the case where Ar gas is used alone and the case where blowing of gas is not conducted, thus proving a remarkable improvement in the decarburization rate.

When the hydrogen gas is blown by one of the methods shown in FIGS. 6(*a*) to 6(*d*), the amount of hydrogen dissolved was very small, due to the fact that the partial pressure of hydrogen at the gas-liquid interface was very low, as compared with the case where the hydrogen was injected into the molten steel through the tuyeres 9 provided in the vacuum chamber in FIG. 6(*a*) or through the recirculation gas blowing tuyere 8 or injection lance 11 alone. In fact, the experiment conducted by the present inventors showed only a small rise of hydrogen content in the molten steel, e.g., up to 2 ppm or so.

From this fact, it is understood that the effect produced by the method of the present invention as shown in FIGS. 6 (*b*) to (*d*) in improving the decarburization rate is attributable to a mechanism which is fundamentally different from the mechanism disclosed in Japanese Patent Laid-Open No. 57-194206 in which decarburization reaction is promoted by an increase in the area of the reaction site through a vigorous generation of bubbles caused by dissolution of a large amount of hydrogen in molten steel.

The mechanism which provides the improvement in the decarburization rate in accordance with the method of the present invention has not been theoretically clarified yet. It is, however, considered that the improvement in the decarburization rate offered by the method of the present invention is attributable to a marked increase in the coefficient of movement of substance in the liquid phase due to Marangoni effect caused by gradient of surface tension which is developed by an increased oxygen concentration gradient at the surface of the molten steel as a result of blowing of hydrogen.

According to the present invention, the introduction of hydrogen into molten steel can be effected by injecting or blowing, by injection or blowing means described before, a suitable medium which contains hydrogen and which allows hydrogen to be present in the molten steel through dissociation, e.g., a hydrogen-containing gas, water, steam or the like.

(4) According to the present invention, decarburization of molten steel can be carried to a low carbon content which could be never be attained by conventional methods, by conducting a vacuum decarburization is conducted by using an RH vacuum degasifier under conditions which meet the above-described three major features, as will be understood description of Examples which will be given later.

In order to attain a further reduced carbon content, as well as further enhanced decarburization rate, it is preferred that a hydrogen containing gas is introduced from a recirculation gas blowing tuyeres 8 provided on the wall of a recirculation pipe 4 as shown in FIGS. 6(*a*) to 6(*f*). Such introduction of hydrogen increases the hydrogen content [H] in the molten steel and enhances the rate of decarburization in the vacuum chamber.

In order that the decarburization efficiency is further improved in a low-carbon patent region where the carbon content [C] is 25 ppm or below, it is preferred that a hydrogen containing gas is injected into the molten steel 7 in a ladle directly both through an injection lance 11 immersed in the molten steel 7 and through the recirculation gas blowing tuyere 8.

Figure 3:
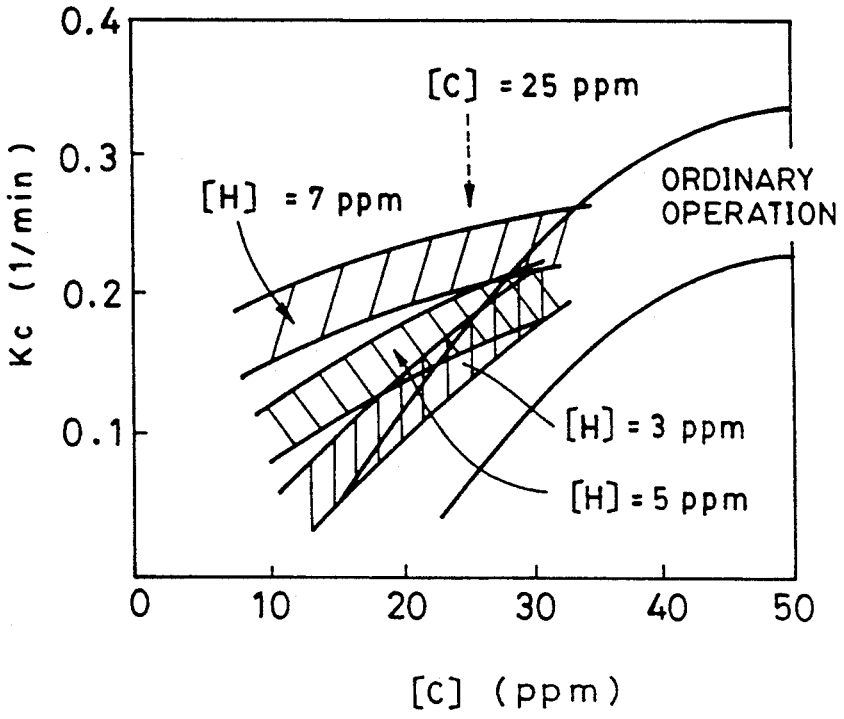
FIG. 3 is a graph showing the relationship between the decarburization rate constant Kc and mean carbon content [C] as obtained when hydrogen gas is introduced both through a recirculation gas blowing tuyere and an injection lance.

Injection of the hydrogen-containing gas conducted both through the injection lance 11 and the tuyere 8, the hydrogen content [H] in the molten steel to be enhanced to 5 to 7 ppm, with the result that the decarburization rate constant Kc is remarkably improved as shown in FIG. 3. The reduction in the decarburization rate in the region of the carbon content [C] being 25 ppm or less, therefore, can be suppressed as compared with the case where the simultaneous introduction through the injection lance 11 and the recirculation gas blowing tuyere 8 is not carried out.

A similar effect can be attained by adopting blowing of a hydrogen-containing gas through the hydrogen blowing tuyere 9 or through the top blowing lance 10, in addition to the introduction through the injection lance 11 and the recirculation gas tuyere 8, as shown in FIG. 6(*e*).

Figure 7:
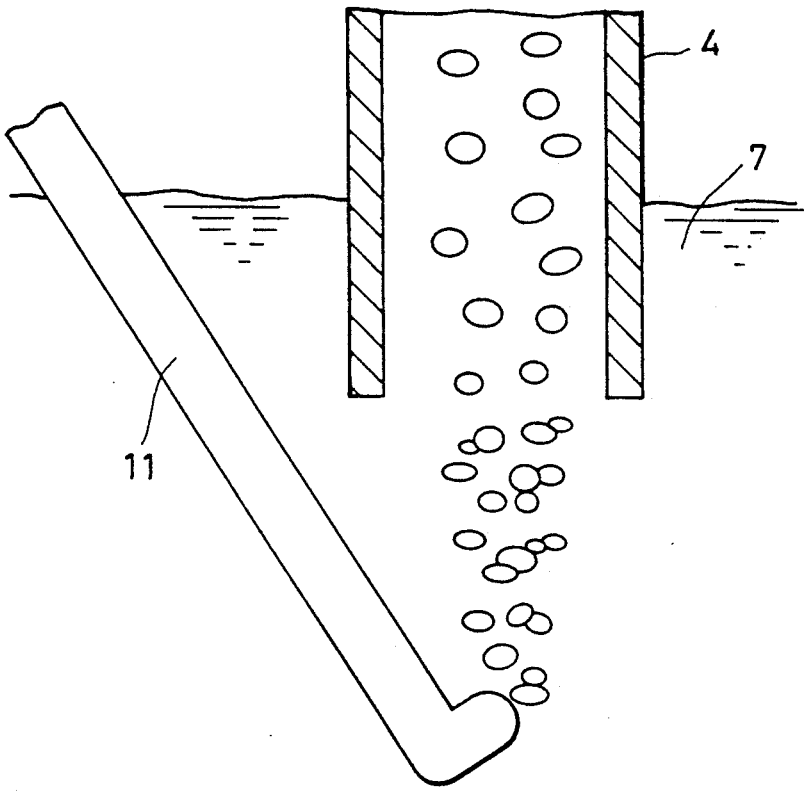
FIG. 7 is a schematic sectional view of a vacuum degasifier of the type in which the gas blowing outlet of an injection lance is disposed immediately under a recirculation pipe.

The injection of hydrogen-containing gas into the molten steel in the ladle is preferably conducted such that the gas outlet of the injection lance 11 is positioned directly below the recirculation pipe of an RH degasifier as shown in FIG. 7. Such an arrangement ensures that hydrogen is introduced without fail into the gas recirculation pipe 4 so that hydrogen gas is not allowed to escape from the molten steel surface and burning of hydrogen on the molten steel surface in the ladle does not occur.

(5) The decarburization process is preferably completed in 20 minutes or so, considering a continuous casting method which follows the decarburization process. To this end, it is necessary that the amount of introduction of hydrogen in accordance with the method of the invention is determined on the basis of the final carbon content to be attained and the carbon content obtained at the time of commencement of introduction of hydrogen.

Figure 4:
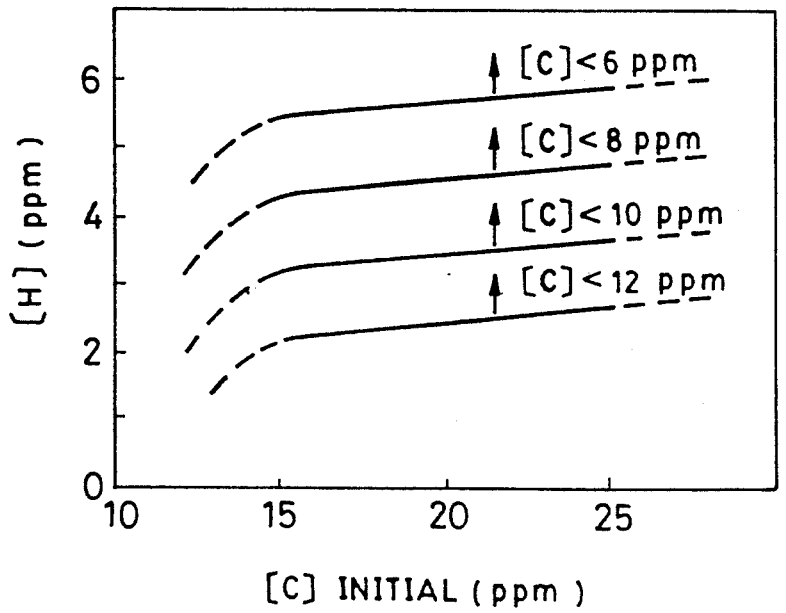
FIG. 4 is a graph showing the relationship between the hydrogen content [H] and the carbon content [C] as observed when hydrogen gas is introduced both through a recirculation gas blowing tuyere and an injection lance.

FIG. 4 shows the results of an experiment in which decarburization was conducted for a period of 8 minutes while varying the carbon content [C] at the time of commencement of introduction of hydrogen, both through a recirculation gas blowing tuyere 8, and an injection lance 11 as shown in FIG. 6(*e*), in the region of the initial carbon content [C] being less than 25 ppm. In the case where the target carbon content [C] is less than 10 ppm, the hydrogen content [H] at which the hydrogen content has become steady at [C]=25 ppm is determined substantially by [H]≧3.8 ppm. In case of the target carbon content [C] being less than 6 ppm, the hydrogen content [H] at which the carbon content [C] being 25 ppm is obtained is substantially [H]≧5.9 ppm.

From the results of this experiment, it is understood that the hydrogen content [H] in the region of [C]<25 ppm meets the condition expressed by the following formula (1), in order to produce an ultra-low-carbon steel having a carbon content [C] less than 10 ppm without disturbing the subsequent continuous casting process.

$$[H] \geqq (8-0.5[C]f)+([C]i-[C]f)/20 \quad (1)$$

where, [C]f represents the final carbon content [C] (ppm) to be obtained at the end of the decarburization, while [C]i represents the carbon content [C] (ppm) as obtained when the hydrogen content has become steady. If the hydrogen content has become steady in a region of [C]>25 ppm, the value of the final carbon content [C]f is set to 25 (ppm).

Figure 8:
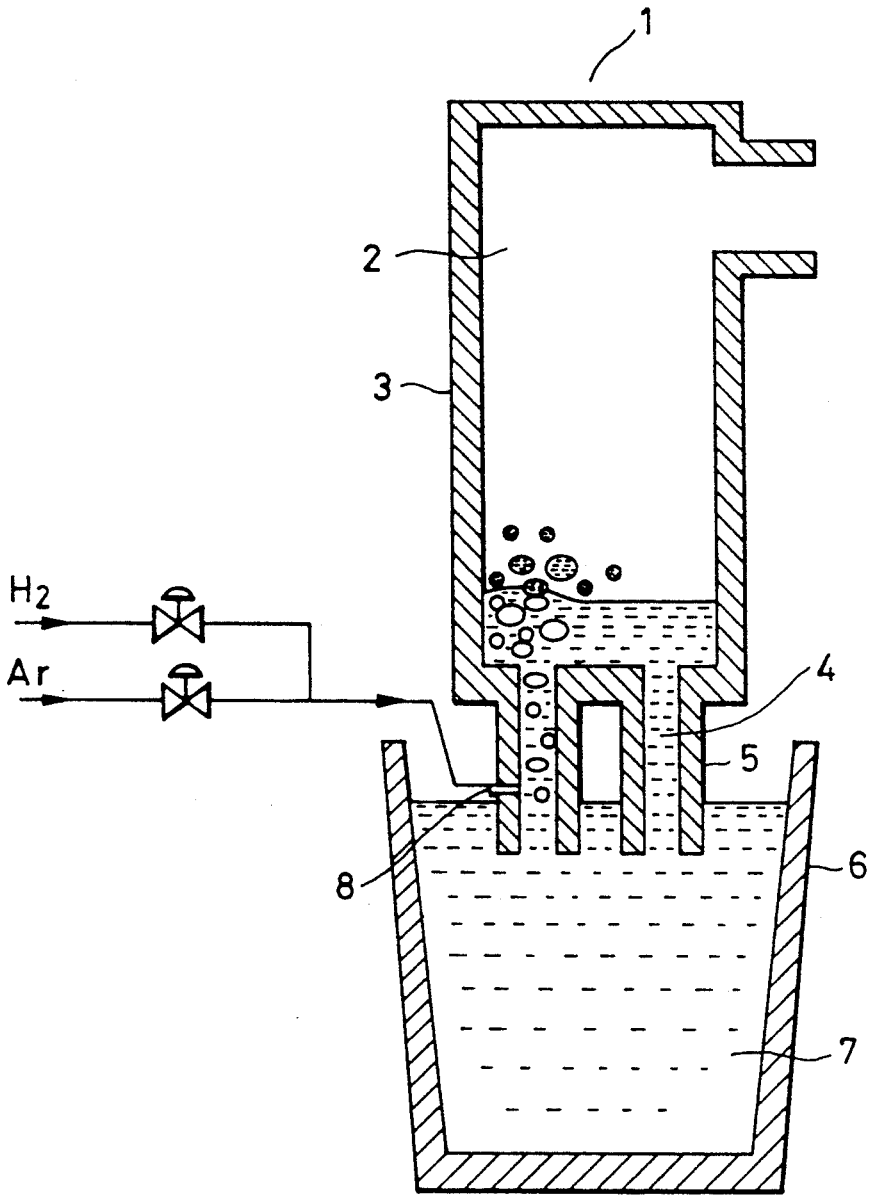
FIG. 8 is a schematic sectional view of equipment for use in carrying out the conventional method.

FIG. 8 shows a conventional method in which Ar gas is introduced into the molten steel.

EXAMPLE 1

Decarburization was conducted by using an RH vacuum degasifier of FIG. 6(*a*) having a capacity of 250 tons. Four hydrogen gas blowing tuyeres 9, each having a diameter of 3 mm, were connected to the side wall 3 of the vacuum chamber 2 at a level below the surface of the molten steel. A rimmed decarburization of a molten steel having a carbon content [C] of 400 ppm and an oxygen content [O] of 450 ppm was conducted in accordance with the RH process by using the above-described equipment. The rate of introduction of the gas through the recirculation gas blowing tuyere 8 was set to 3 $Nm^3$/min in a high-carbon region. In a first case, decarburization was started by an ordinary method and introduction of hydrogen gas and Ar gas, at rates of 3 $Nm^3$/min and 0.5 $Nm^3$/min, respectively, was commenced through the hydrogen blowing tuyeres 9 provided on the sidewall 3 of the vacuum chamber 2, when the carbon content [C] in the molten steel, as measured on the basis of rates of generation of CO and $CO_2$ in the exhaust gas, has become 50 ppm. In a second case, hydrogen gas and Ar gas were introduced at rates of 2 $Nm^3$/min and 1.0 $Nm^3$/min, respectively, through the recirculation gas blowing tuyeres 8 of the recirculation pipe, and moreover hydrogen gas and Ar gas were introduced at rates of 2 $Nm^3$/min and 0.3 $Nm^3$/min through the hydrogen blowing tuyeres 9. During the decarburization, the hydrogen content was maintained between 3.5 and 5 ppm.

Figure 5:
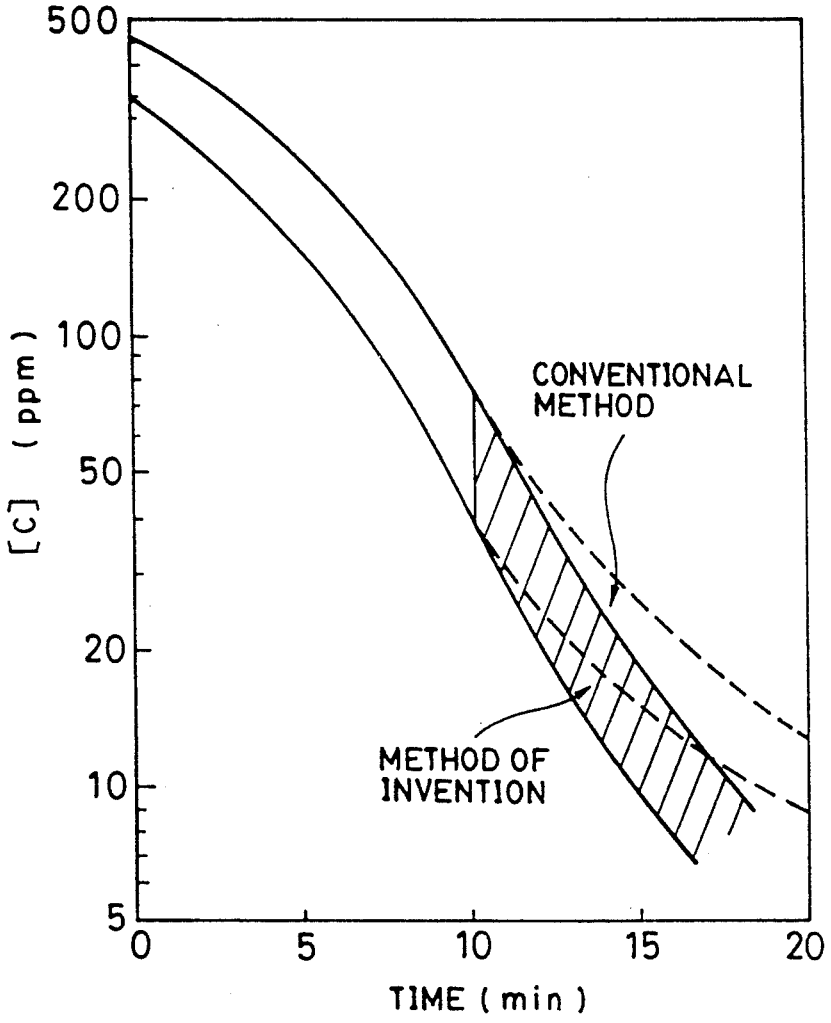
FIG. 5 is a chart showing decarburization curves which represent decarburization characteristics of the method in accordance with the invention and a conventional method.

FIG. 5 shows the manner in which the carbon content [C] is decreased in relation to time. It will be seen that the method of the present invention can promote the decarburization reaction in the ultra-low-carbon region as compared with the conventional method in which hydrogen gas and Ar gas are introduced at rates of 3 $Nm^3$/min and 0.5 $Nm^3$/min only through the recirculation gas blowing tuyeres 8.

EXAMPLE 2

The equipment used in this Example had, as in the case of the apparatus shown in FIG. 6(*b*), eight hydrogen gas blowing tuyeres 9 of 4 mm diameter made of a stainless steel were connected to the sidewall 3 of the vacuum chamber 2 at a level which is 1400 mm above the supposed level of the molten steel surface so as to blow hydrogen onto the molten steel surface obliquely downward at an angle of 45°.

In this Example, 250 tons of non-deoxidized molten steel prepared by a converter, having a carbon content [C] of about 400 ppm and oxygen content [O] of about 450 ppm was decarburized by the RH degasifier. The decarburization was started by a conventional method in which Ar gas was introduced through the recirculation gas blowing tuyeres 8. After a 10-minute operation by this ordinary decarburizing method, introduction of hydrogen gas was commenced. Meanwhile, the rate of supply of recirculation Ar gas was maintained constant at 2.0 $Nm^3$/min. The carbon content [C] at the moment 10 minutes after the start of decarburization was 30 ppm as the mean value. In the period of 10 minutes after the start of decarburization, Ar gas was supplied at a rate of 0.5 $Nm^3$/min from the hydrogen blowing tuyeres 9, in order to prevent clogging of these tuyeres 9.

After the 10-minute ordinary decarburizing operation, introduction of hydrogen gas was commenced by operating valves so as to blow the hydrogen gas at a rate of 7.5 $Nm^3$/min. The decarburization was ceased after the introduction of hydrogen gas was continued for 10 minutes. The hydrogen content [H] ranged between 1 and 2 ppm when the decarburization was ceased. After the completion of the decarburization, Ar gas was supplied under the same condition as the period before the commencement of introduction of hydrogen, followed by an Al deoxidation.

The carbon content [C] of the molten steel at the time of completion of decarburization was 7.7 ppm in terms of a mean value, thus proving the speediness of decarburization by the method of the invention at an ultra low carbon region of [C] being less than 10 ppm. The standard deviation of the final carbon content [C] was as small as 0.7 ppm.

EXAMPLE 3

In Example 3, hydrogen gas was blown towards the surface of the molten steel through a vertically movable top blowing lance 10 in a manner shown in FIG. 6(*d*).

The top blowing lance 10 was stationed at the elevated position in the initial period of 2 minutes after the start of the decarburization. Then, the top blowing lance 10 was lowered to position its outlet at a level which is about 1.8 to 3.2 m above the supposed level of the molten steel surface, and $O_2$ gas was blown through this lance 10 at a rate of 15 to 20 $Nm^3$/min, for the purpose of decarburization of the molten steel and burning of the waste gas. The supply of the oxygen gas was conducted for 3 to 8 minutes. Meanwhile, Ar gas was introduced into the recirculation pipe 4 through the recirculation gas blowing tuyere 8 so as to conduct ordinary decarburization for 10 minutes, followed by introduction of hydrogen gas.

Namely, while blowing the hydrogen gas and Ar gas at rates of 2 $Nm^3$/min and 1 $Nm^3$/min, respectively, hydrogen gas was blown at a rate of 15 $Nm^3$/min from the top blowing lance 10 lowered to the above-mentioned position. The decarburization was ceased after 10-minute blowing of hydrogen from the top blowing lance 10. The hydrogen content [H] generally ranged between 3 and 3.5 ppm when the decarburization was finished. After the completion of decarburization, Al deoxidation was conducted while maintaining the same gas blowing condition as that used in the period before the commencement of blowing of hydrogen. The means value of the carbon content [C] and the standard deviation of the carbon content [C] were respectively 7.5 ppm and 0.6 ppm, when the decarburization was finished.

EXAMPLE 4

In Example 4, ordinary decarburization was conducted for 8 minutes by introducing Ar gas through the recirculation gas blowing tuyeres 8 at a rate of 2.0 $Nm^3$/min. Then, hydrogen gas was injected at a rate of 3 $Nm^3$/min through an immersed injection lance 11 of the type shown in FIG. 6(*e*), simultaneously with the introduction of hydrogen gas and Ar gas at rates of 3.0 $Nm^3$/min and 1.0 $Nm^3$/min through the recirculation gas blowing tuyere 8. The carbon content [C] at which the hydrogen content [H] in the molten steel became steady was 25 ppm as a mean value. The injection of hydrogen was conducted for 9 minutes. The final carbon content [C] after completion of decarburization was 7.8 ppm. During the supply of hydrogen, the hydrogen content [H] was maintained substantially at 4.8 ppm.

In this Example, the immersed injection lance 11 was set such that its outlet is positioned directly below the recirculation pipe 4 at a level which is 2.6 m below the molten steel surface and 0.6 m above the ladle bottom, as shown in FIG. 7.

Burning of hydrogen on the molten steel surface, which takes place when the hydrogen is allowed to directly escape from the molten steel surface, was not observed throughout the period of the decarburization operation.

As will be understood from the foregoing description, the present invention offers the following advantages.

Firstly, it is to be pointed out that the method of the present invention enables a quick decarburization in a region where the carbon content is extremely low. Using the method of the invention, therefore, ultra-low-carbon steel having an ultra low carbon content less than 10 ppm can be stably mass-produced. In addition, generation of splash metal is avoided in the vacuum chamber, thus eliminating problems such as deposition of metal to the inner surface of the vacuum chamber wall. For the same reason, various troubles which would affect safe operation of the production system, such as damaging of equipment, extraordinary wear of refractories, and so forth, can be avoided by the method of the present invention.

What is claimed is:

1. A method of producing an ultra-low carbon steel by vacuum-decarburizing a molten steel by means of a vacuum degasifier of the type having recirculation pipes and a vacuum chamber, said method comprising: introducing, when the carbon content of said molten steel is 50 ppm or less, hydrogen gas together with an inert gas into said molten steel by directly injecting a hydrogen-containing gas into the molten steel in said vacuum chamber through a tuyere provided in the wall of said vacuum chamber.

2. A method of producing an ultra-low-carbon steel by vacuum-decarburizing a molten steel by means of a vacuum degasifier of the type having recirculation pipes and a vacuum chamber, said method comprising: introducing, when the carbon content of said molten steel is 50 ppm or less, hydrogen gas together with an inert gas into said molten steel by blowing the hydrogen-containing gas onto the surface of said molten steel in said vacuum chamber through a lance provided in said vacuum chamber.

3. A method of producing an ultra-low carbon steel by vacuum-decarburizing a molten steel by means of a vacuum degasifier of the type having recirculation pipes and a vacuum chamber, said method comprising: introducing, when the carbon content of said molten steel is 50 ppm or less, a hydrogen-containing gas through a tuyere connected to said recirculation pipe and through an injection lance immersed in the molten steel held by a ladle.

4. A method of producing an ultra-low-carbon steel according to claims 1 or 2, wherein said hydrogen-containing gas is injected into said molten steel from a tuyere provided in the sidewall of said recirculation pipe.

5. A method of producing an ultra-low-carbon steel according to claim 4, wherein said hydrogen-containing gas is directly injected into said molten steel through an injection lance immersed in the molten steel held by a ladle.

6. A method of producing an ultra-low-carbon steel according to claims 3 or 5, wherein the hydrogen content [H] (ppm) in said molten steel during decarburization process is maintained to satisfy the following condition:

$$[H] \geqq [8-0.5[C]f]+([C]i-[C]f)/20 \ (ppm)$$

where, [C]i represents the carbon content (ppm) of said molten steel obtained when said hydrogen content [H] has become substantially steady in the region of the carbon content [C] being not greater than 25 ppm, and [C]f represents the target carbon content (ppm) to be attained at the end of decarburization.

* * * * *